US007553171B2

(12) United States Patent
Wang et al.

(10) Patent No.: US 7,553,171 B2
(45) Date of Patent: Jun. 30, 2009

(54) POWER PLUG ASSEMBLY WITH IMPROVED CONNECTOR CONFIGURATION

(75) Inventors: Chang-Yin Wang, Kunshan (CN); Wei-Ya Cheng, Kunshan (CN); Su-Feng Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/217,986

(22) Filed: Jul. 10, 2008

(65) Prior Publication Data

US 2009/0017654 A1 Jan. 15, 2009

(51) Int. Cl.
*H01R 4/66* (2006.01)

(52) U.S. Cl. ..... 439/106; 439/695

(58) Field of Classification Search ..... 439/106, 439/695

See application file for complete search history.

(56) References Cited

U.S. PATENT DOCUMENTS 4,790,776 A * 12/1988 Iijima ..... 439/695
5,282,753 A * 2/1994 Su ..... 439/106
6,168,443 B1 * 1/2001 Mullen et al. ..... 439/106
6,966,799 B1 * 11/2005 Wang ..... 439/695
7,297,016 B1 * 11/2007 Tymkewicz et al. ..... 439/695

FOREIGN PATENT DOCUMENTS

CN 2153866 Y 1/1994

* cited by examiner

*Primary Examiner*—Tho D Ta
(74) *Attorney, Agent, or Firm*—Wei Te Chung

(57) ABSTRACT

A power plug assembly with improved connector configuration, comprises an inner base member defining at least two channels each provided with a retaining member having a transition portion and a deformable positioning portion extended from thereof. At least two terminals are snugly received into the corresponding channels including a retaining portion engaged with the retaining member, a mating portion extended out of the channel and a rear portion. At least two conductive wires are electrically engaged with the rear portion of the terminals.

9 Claims, 7 Drawing Sheets

POWER PLUG ASSEMBLY WITH IMPROVED CONNECTOR CONFIGURATION

FIELD OF THE INVENTION

The present invention relates to a power plug assembly, and more particularly to a kind of power plug assembly with an improved connector configuration facilitating reliable service life and cost effective production.

DESCRIPTION OF PRIOR ART

Power plug assembly is more and more widely used in the connection of various home electric appliances to the AC outlet now, thus more and more manufacturers and researchers have paid more attention to design the power plug assembly which are more securely and easily to be manufactured. Generally, the power plug assembly has two-pole or three-pole electrical pin therein, and the three-pole power plug assembly is more securely in the using process, so the three-pole power plug assembly is widely used in the home electric appliances now.

China Patent Issued No. CN 2153866Y discloses a kind of power plug assembly, please referring to FIGS. 1 to 5 in the above mentioned patent, the conventional three-pole power plug assembly comprises an inner pin base member 1, a ground, a positive, and a negative terminal 3,4,5 respectively assembled to the inner pin base member 1. And the inner pin base member 1 has a passageway 11 at its top portion into which is for the ground terminal 3 to be inserted, a lower tongue piece 14 extending out from the inner surface of the passageway 11 in a longitudinal direction is to be seen as a cantilever, further a projected portion 141 formed at the end of the lower tongue piece 14 is to be engaged with the ground terminal 3. The inner pin base member 1 has a pair of opposite U-shaped portions (not labeled in FIGS.) extending from one sides of the lower portion of the inner pin base member 1 and respectively having a slot (not labeled in FIGS.) therein. A pair of channels 12,13 are separately formed at the opposite sides of the lower portion of the inner pin base member 1 and respectively communicated with the slots of the two opposite U-shaped portions.

Whereas, when the ground terminal 3 pass through the passageway 11 of the inner pin base member 1, the lower tongue piece 14 will be deserved downward pressure from the ground terminal 3 and focused on the end portion thereof where a projected portion 141 upwardly formed, thus, the lower tongue piece 14 will be easily deflected due to the uneven pressure, if the pressure effected on the lower tongue piece is much larger, the tongue piece will be turnovered or broken. Moreover, the material of the inner base member 1 will be increased obviously due to the inner pin base member 1 further having two opposite U-shaped portions, so that the production cost of the inner pin base member 1 will also be increased.

As discussed above, an improved power plug assembly overcoming the shortages of existing technology is needed.

SUMMARY OF THE INVENTION

Accordingly, an object of the present invention is to provide a kind of power plug assembly having an improved inner base member for conveniently and firmly positioning the terminal.

A further object of the present invention is to provide a kind of power plug assembly at a lower production cost and suitable for mass production.

In order to achieve the above-mentioned objects, a power plug assembly in accordance with the present invention comprises an inner base member defining at least two channels each provided with a retaining member having a transition portion and a deformable positioning portion extended from thereof; at least two terminals, each snugly received into the corresponding channels, and including a retaining portion engaged with the retaining member, and a mating portion, extending out of the channel, each terminal further including a rear portion; and at least two conductive wires each electrically engaged with the rear portion of each terminal. A power plug connector assembly further comprises: an inner base member, defining a passageway at a top portion thereof, a pair of channels separately disposed at a lower portion thereof, a through hole formed below the passageway and communicated with the passageway and a supporting member extended from the inner side of the through hole windingly; a ground terminal, received into the passageway and engaged by the supporting member; a positive and a negative terminal, respectively received into the channels; a cable with a plurality conductive wires, electrically connected to the positive, negative and ground terminals; and an insulative cover, wrapped to the inner base member through injection molding.

Other objects, features and advantages of the invention will be apparent from the following detailed description taken in connection with the accompanying drawings.

DETAILED DESCRIPTION OF PREFERRED EMBODIMENTS

Figure 1:
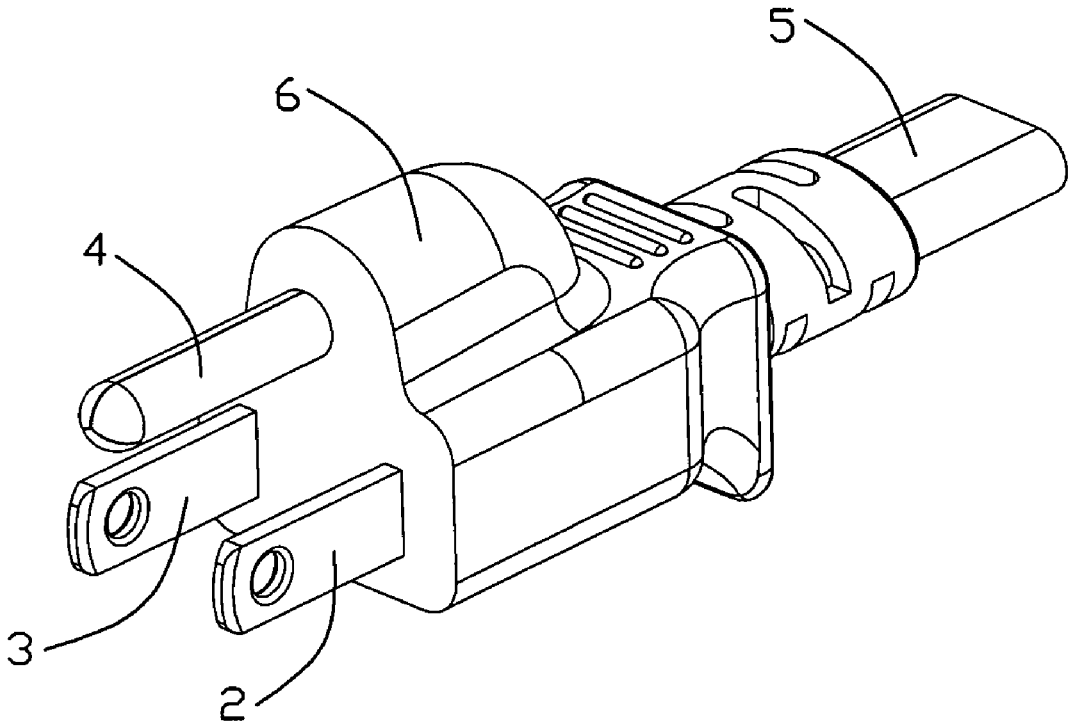
FIG. 1 is a perspective view of a power plug assembly made in accordance with the present invention.

Reference will now be made to the drawing figures to describe the present invention in detail.

Referring to FIGS. 1 to 3, 5 and 7, a power plug assembly with improved connector configuration in accordance with the present invention adapter for mating with the complementary connector (not shown in FIGS.) includes an inner base member 1, a positive terminal 2, a negative terminal 3 and a ground terminal 4 received into the inner base portion 1, a cable 5 with a plurality of conductives 51 electrically connected to the positive, negative, ground terminals 2,3,4 and an insulative cover 6 wrapped to the inner base member 1 through injection molding.

The inner base member 1 is mainly an injection molded plastic article and has a top portion and a bottom portion extending downwardly from the top portion. The inner base member defines a rear surface 16 and a front surface 17 opposite to the rear surface 16. The inner base member 1 has a round-section passageway 11 at its top portion for receiving the ground terminal 4, and also have a pair of channels 12,13 separately disposed at two opposite side sections at its bottom portion for receiving the positive and negative terminals 2,3.

Figure 2:
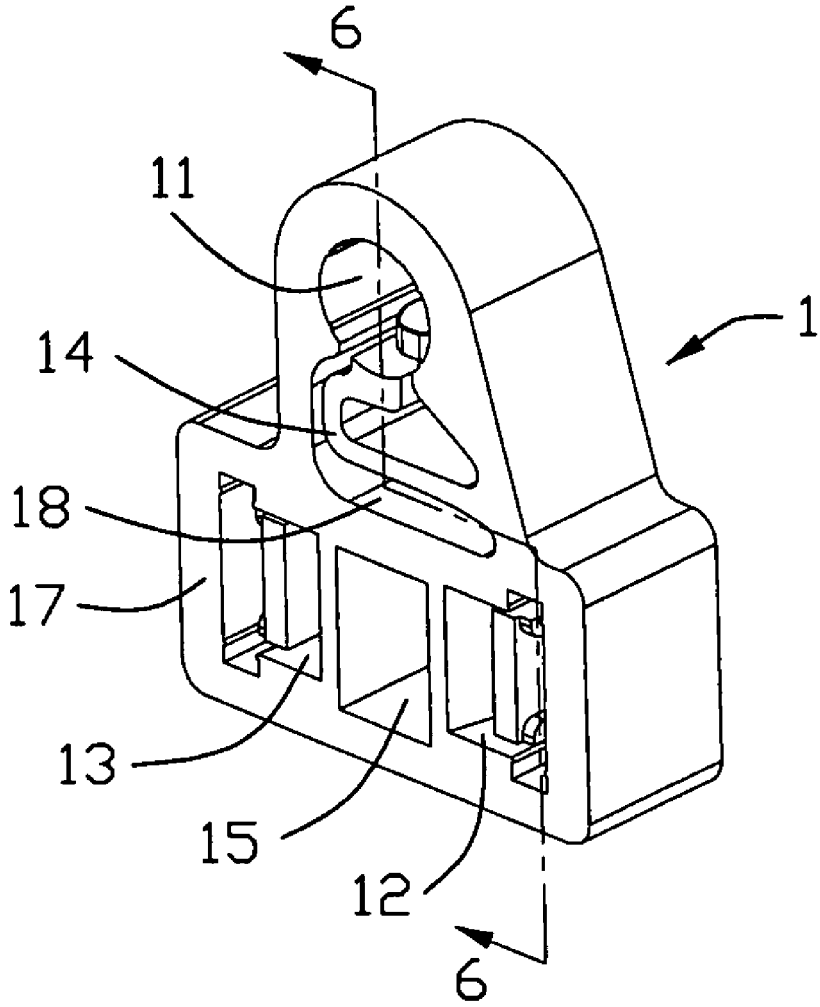
FIG. 2 is a front and left perspective view of the inner base member made in accordance with the present invention.
Figure 3:
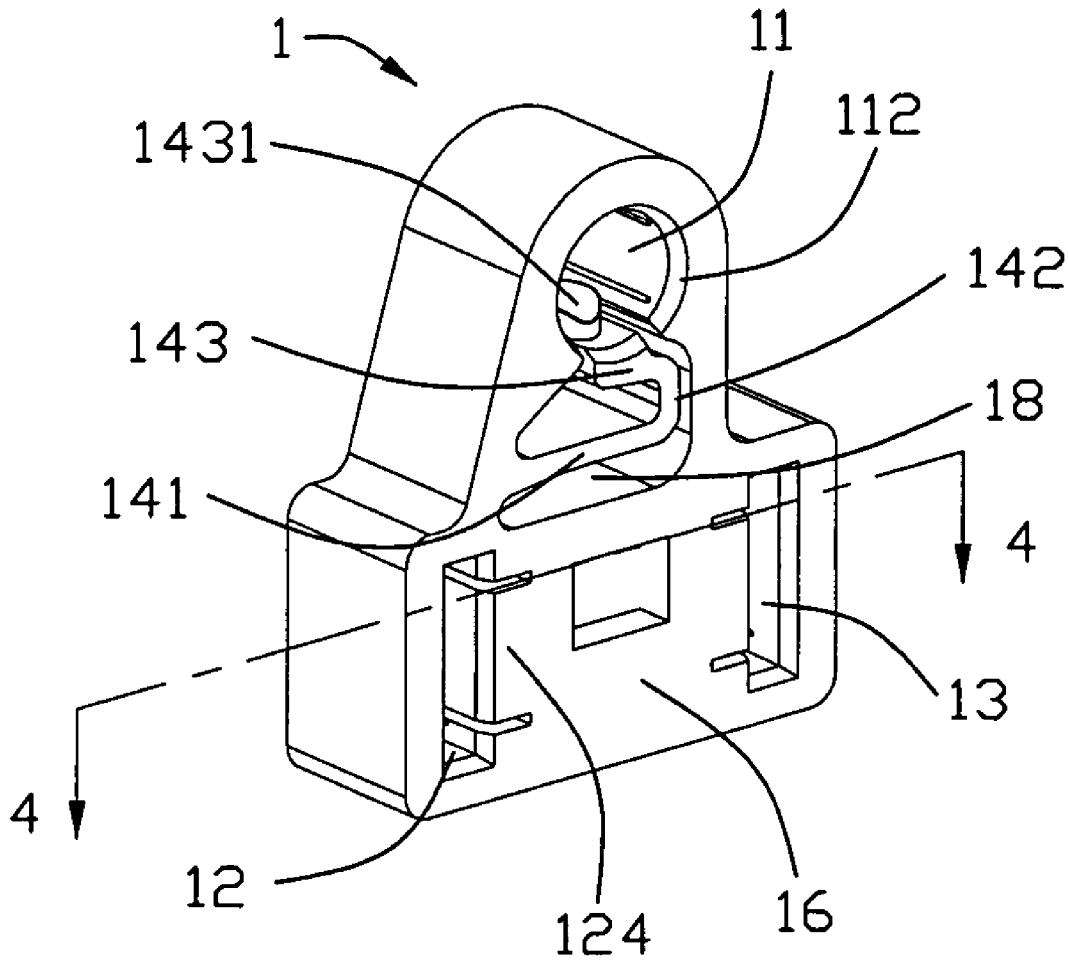
FIG. 3 is a rear and left perspective view of the inner base member made in accordance with the present invention.
Figure 4:
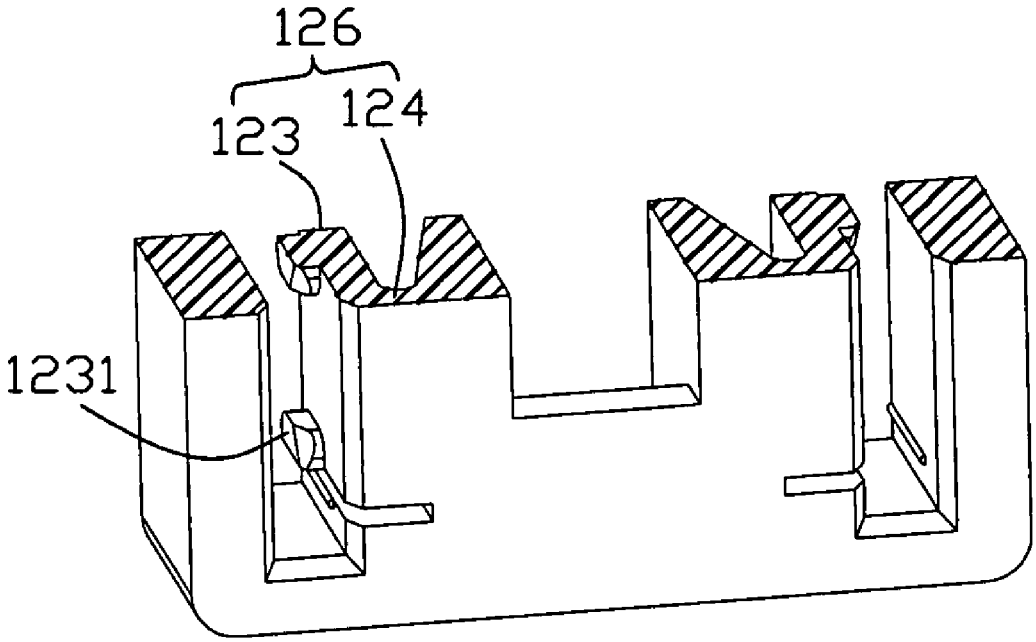
FIG. 4 is a cross-section view of the inner base member taken along line 4-4 of FIG. 3.
Figure 6:
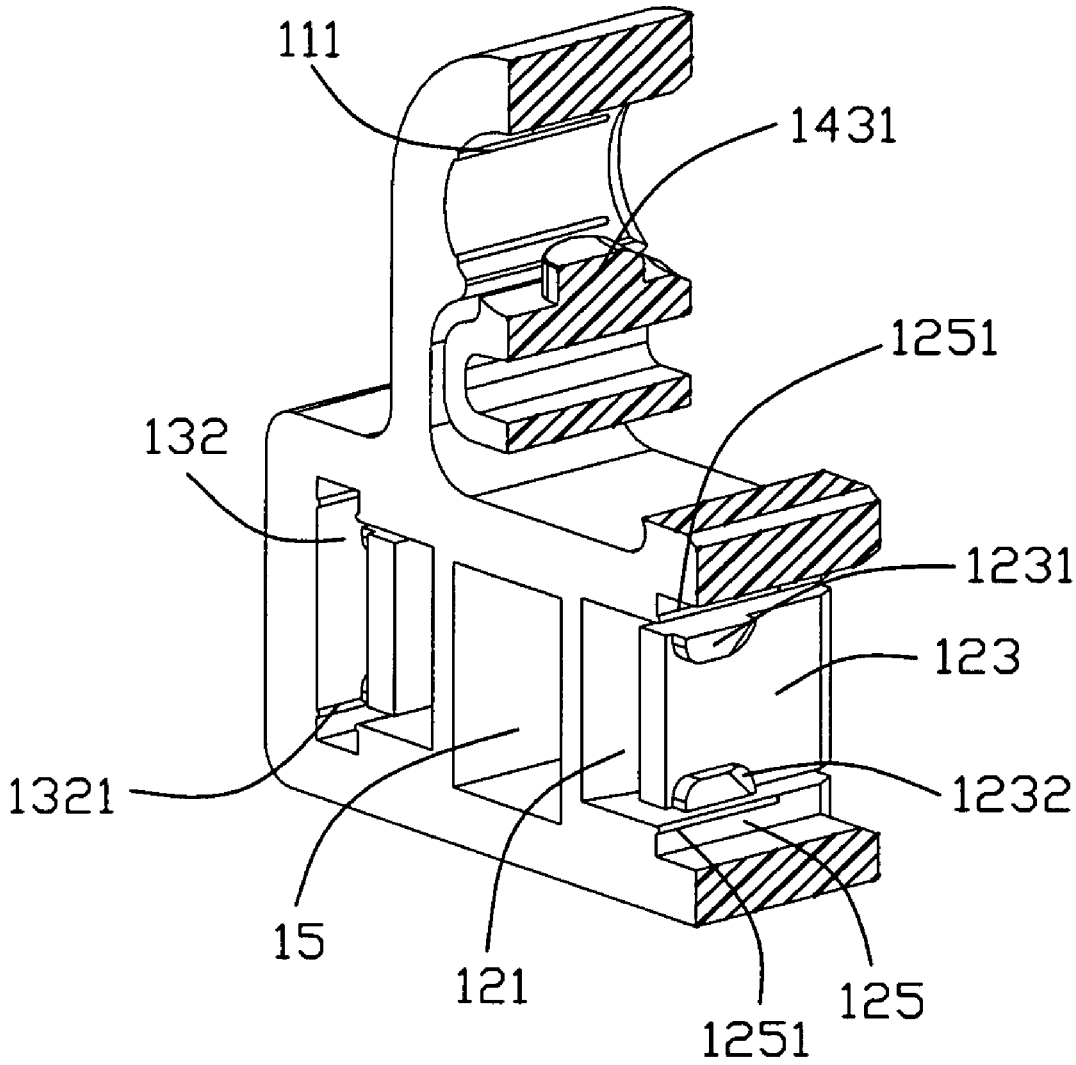
FIG. 6 is a cross-section view of the inner base member taken along line 6-6 of FIG. 2.

Referring to FIGS. 2 to 3 and 6, the round-section passageway 11 has several ribs 111 extending from its inner surface for increasing the engaging force between the passageway 11 and the ground terminal 4, and the rear opening end of the passageway 11 has a chamfer 112 around thereof, thus when the ground terminal 4 is about to insert into the passageway 11, the chamfer 112 can guide the ground terminal 4 into the passageway 11 smoothly. In addition, a not regular through hole 18 is formed below the passageway 11 and communicated with the passageway 11, and a supporting member 14 extends from one inner side of the through hole 18 windingly. In detail, the supporting member 14 comprises a tongue portion 141 extending from one inner side of the through hole 18 to another, a flection portion 142 extending from the end of the tongue portion 141 upwardly and a platform portion 143 turning back to the original inner side of the through hole 18, the tongue portion 141 also can be seen as an lower supporting portion, and the platform portion 143 can be seen as an upper supporting portion, so when the upper and lower supporting portion are working together, the supporting member 14 is more elasticer to hold the ground terminal 4 making the supporting member 14 not easily to be broken by the downward pressure from the ground terminal 4. The platform portion 143 has a concave upper surface which is sunken inwardly, and an projected portion 1431 extends upwardly from the concave surface for engaging with the ground terminal 4. A rectangle hole 15 disposed in the middle section of the bottom portion of the inner base member 1 extends from the rear surface to the front surface of the inner base member 1 and respectively has a small size opening end and a large size opening end thereof.

Referring to FIGS. 2 to 4 and 6, the inner base member 1 has a pair of channels 12,13 separately disposed at two opposite sides of the bottom portion of the inner base member 1 to allow the positive terminal 2 or negative terminal 3 to passthrough. The channels 12,13 each has a T-shaped opening end on the rear surface 16 and front surface 17 of the inner base member 1 with a retaining member 126 therein and defines a chamfer (not labelled) around the rear opening end for anti-mismating when the positive terminal 2 and negative terminal 3 are inserted into the channels 12,13. The channels 12,13 each defines a first inner side 121 and a second inner side (not labelled) opposite to the first inner side 121. Two retaining members 126 each defines a transition portion 124 respectively extended laterally from the first inner side 121 of the channels 12,13 for a preselective distance, and a deformable positioning portion 123 extended from the end of the transition portion 124 forwardly. The deformable positioning portion 123 further has a pair of projected portions 1231 extended respectively from the opposite upper and lower sides thereof, and each has a round surface (not labelled) at the front end and a chamfer 1232 at the rear end thereof. A pair of ribs 1251 are respectively disposed on an upper and a lower stepped surfaces 125 of the channels 12,13. A pair of the ribs 1321 are formed on the second side inner surface of the channels 12,13 and vertically spaced.

Figure 5:
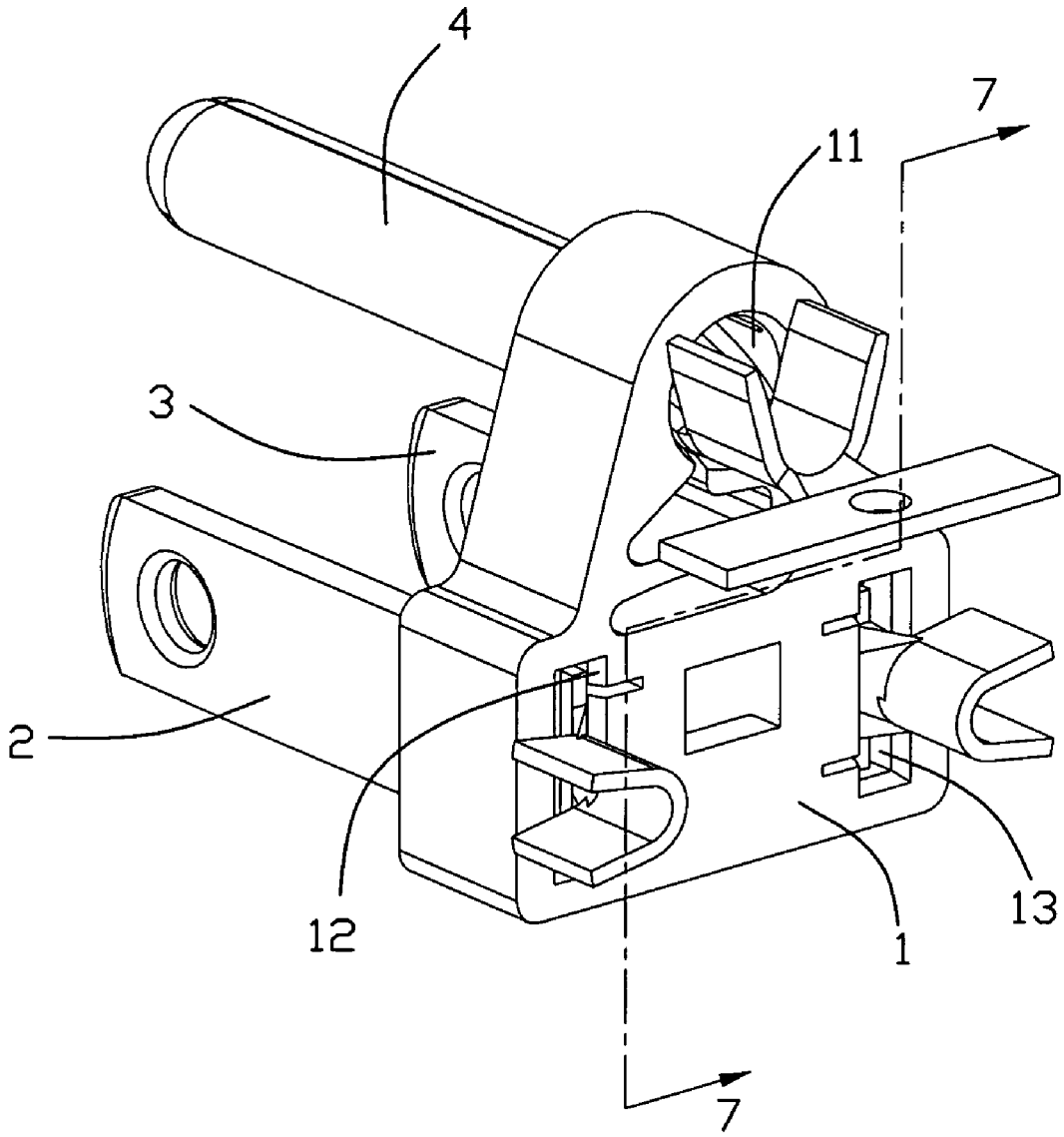
FIG. 5 is a rear and left perspective view of the inner base member with the terminals made in accordance with the present invention.
Figure 7:
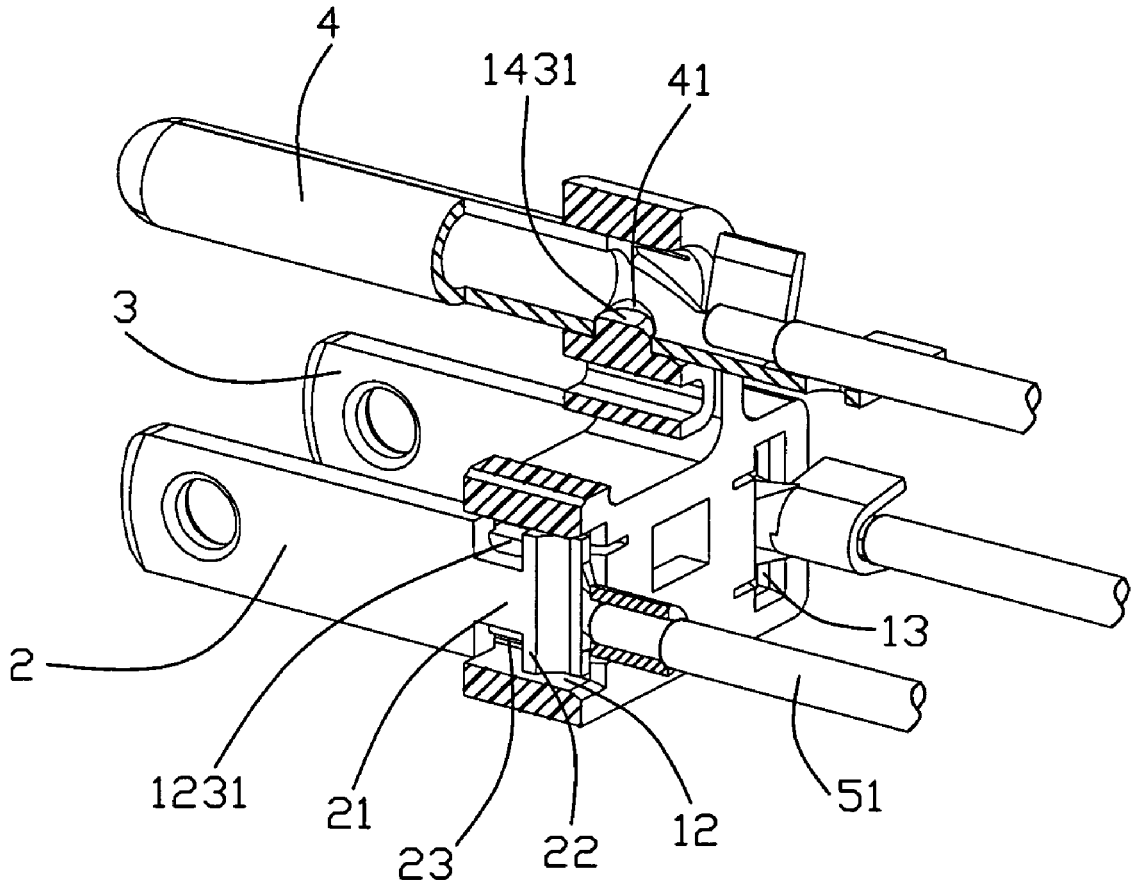
FIG. 7 is a cross-section view of the inner base member with the terminals taken along line 7-7 of FIG. 5 and further with conductive wires of cable.

Referring to FIGS. 5 and 7, the ground terminal 4 is hollow and defines a oval hole 41 at the rear end of the ground terminal 4 engaged with the projected portion 1431. The positive and negative terminals 2,3 are flat and received in the channels 12,13, the positive terminal 2 defines a retaining portion 21 positioned between the projected portions 1231, a mating portion (not labelled) extending out of the channel and a rear portion (not labelled) electrically connected to the conductive wires 51 of the cable 5. The positive terminal 2 further has a pair of shoulders 22 disposed at two opposite sides of the retaining portion 21 to form a pair of recesses 23 and spaced by the retaining portion 2 for receiving the projected portions 1231. So, the positive terminal 2 can be firmly positioned in the inner base member 1 and will not be removed in a longitudinal direction. Also, the negative terminal 3 has the same structure with the positive terminal 2.

Referring to FIGS. 1 to 7, the assembling process of the power plug assembly in according to the present invention starts from assembling the ground, positive and negative terminals 2,3,4 electrically connected to conductive wires 51 of the cable 5 into the inner base member 1. To assemble the terminals, first insert the ground terminal 4 through the passageway 11, allowing the oval hole 41 at the rear end of the ground terminal 4 engaged with the upward projected portion 1431 on the supporting member 14. Then insert the positive and negative terminals 2,3 through the channels 12,13, respectively, until the retaining portion 21 of the positive terminal and negative terminal 2,3 positioned between the projected portions 1231 of the deformable positioning portion 123 and the projected portions 1231 received into the recess 23 formed by a pair of shoulders 22. The ground terminal 4 is supported by the supporting member 14 by the engagement of the projected portions 1431 of the supporting member 14 with the oval hole 41 of the ground terminal 4 and firmly confined in the passageway 11 by the engaging force between several ribs 111 extended from the inner surface of the passageway 11 and the outer surface of the ground terminal 4. Similarly, the positive and negative terminals 2,3 are all supported by the deformable positioning portion 123 of the retaining member 126 by the engagement of the projected portions 1231,1232 of the deformable positioning portion 123 with the retaining portion 21 and the recess 23 of the terminals 2,3 and confined in the channels 12,13 by the engaging force between the ribs 1251,1321 formed on the inner surface of the channels 12,13 and the positive and negative terminals 2,3. Thus, the positive, negative and ground terminals 2,3,4 are firmly retained on the inner base member 1.

After the terminals are assembled to the inner base member 1, then an insulative cover 6 is wrapped to the assembled inner base member 1 through direct injection molding to form a power plug assembly as shown in FIG. 1.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What we claimed is:

1. A power plug assembly with improved connector configuration, comprising:

an inner base member defining at least two channels each provided with a retaining member having a transition portion and a deformable positioning portion extended from thereof;

at least two terminals, each snugly received into the corresponding channels, and including a retaining portion engaged with the retaining member, and a mating portion, extending out of the channel, each terminal further including a rear portion; and at least two conductive wires each electrically engaged with the rear portion of each terminals;

wherein the power plug assembly further comprises a terminal received into a passageway formed on the inner base member upper the channels;

wherein the terminals received into the channels are a pair of positive and negative terminals, the terminal received into the passageway is a ground terminal;

wherein a through hole is formed below the passageway and communicated with the passageway, and a supporting member extends from one inner side of the through hole windingly for supporting the ground terminal;

wherein the supporting member comprises a tongue portion extended from one inner side of the through hole to another, a flection portion extended from the end of the tongue portion upwardly and a platform portion turned back to the original inner side of the through hole.

2. The power plug assembly as recited in claim 1, wherein the supporting member further comprises a projected portion extended upwardly from the platform portion, and the ground terminal defines an oval hole engaged with the projected portion.

3. The power plug assembly as recited in claim 1, wherein the passageway and the channels each has a plurality of ribs therein for positioning the ground, positive and negative terminals.

4. The power plug assembly as recited in claim 1, wherein the power plug assembly further has an insulative cover wrapped to the inner base member through injection molding.

5. The power plug assembly as recited in claim 1, wherein the positive or negative terminal each further has a pair of shoulders disposed at two opposite sides of the retaining portion to form a pair of recesses spaced by the retaining portion.

6. The power plug assembly as recited in claim 5, wherein the deformable positioning portion has a pair of projected portions received into the recesses formed at the opposite upper and lower sides and vertically spaced from each other.

7. The power plug assembly as recited in claim 6, wherein the projected portion has a round surface at the front end and a chamfer at the rear end thereof.

8. A power plug connector assembly, comprising:

an inner base member, defining a passageway at a top portion thereof, a pair of channels separately disposed at a lower portion thereof, a through hole formed below the passageway and communicated with the passageway and a supporting member extended from the inner side of the through hole windingly;

a ground terminal, received into the passageway and engaged with the supporting member; a positive and a negative terminal, respectively received into the channels;

a cable with a plurality conductive wires, electrically connected to the positive, negative and ground terminals; and an insulative cover, wrapped to the inner base member through injection molding;

wherein the supporting member comprises a tongue portion extended from one inner side of the through hole to another, a flection portion extended from the end of the tongue portion upwardly and a platform portion turned back to the original inner side of the through hole.

9. The power plug assembly as recited in claim 8, wherein a retaining member respectively has a transition portion and a deformable positioning portion extended from thereof disposed in each channel of the inner base member.

* * * * *